US007649500B2

(12) United States Patent
Liao et al.

(10) Patent No.: US 7,649,500 B2
(45) Date of Patent: Jan. 19, 2010

(54) FILM ANTENNA ASSEMBLY AND FABRICATION METHOD

(75) Inventors: Chia-Yu Liao, Jhongli (TW); Yuan-Ming Chang, Fongyuan (TW)

(73) Assignee: Paragon Technologies, Co., Ltd., Taipei County (TW)

( * ) Notice: Subject to any disclaimer, the term of this patent is extended or adjusted under 35 U.S.C. 154(b) by 0 days.

(21) Appl. No.: 12/111,038

(22) Filed: Apr. 28, 2008

(65) Prior Publication Data

US 2009/0267839 A1 Oct. 29, 2009

(51) Int. Cl.
*H01Q 1/36* (2006.01)

(52) U.S. Cl. ..... 343/700 MS; 343/906

(58) Field of Classification Search ..... 343/700 MS, 343/767, 906

See application file for complete search history.

(56) References Cited

U.S. PATENT DOCUMENTS 4,222,056 A * 9/1980 Graeser et al. ..... 343/767
4,231,041 A * 10/1980 Graeser et al. ..... 343/767
5,268,700 A * 12/1993 Hirotsu et al. ..... 343/713
7,233,296 B2 * 6/2007 Song et al. ..... 343/713
2004/0066345 A1 * 4/2004 Schadler ..... 343/767

* cited by examiner

*Primary Examiner*—Tan Ho
(74) *Attorney, Agent, or Firm*—Egbert Law Offices PLLC

(57) ABSTRACT

The present invention provides a film antenna assembly and a fabrication method thereof. The assembly includes an antenna body, which is a conducting body placed onto the substrate. The antenna body is provided with a signal connector, a feeder, and a conducting medium. One side of the conducting medium is coupled with the feeder, and the other side is located on the signal connector of antenna body. With this combined structure of the feeder, the film antenna assembly could be protected against damage, and the stable electrical connection resolves the coupling issue of the film antenna and feeder for improved applicability and economic efficiency.

5 Claims, 8 Drawing Sheets

FILM ANTENNA ASSEMBLY AND FABRICATION METHOD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a film antenna, and more particularly to an innovative antenna with an antenna body and feeder in a combined structure as well as a new fabrication method thereof.

2. Description of Related Art Including Information Disclosed Under 37 CFR 1.97 and 37 CFR 1.98.

In the modern information age, there is a growing trend of wireless transmission functions being introduced into electronic products. So, the antenna assembly becomes a key element of a variety of electronic products, such as commonly used mobile phones, notebook computers and PDAs.

An antenna assembly is generally prefabricated into a solid antenna(e.g. an inverted-antenna) by means of punch-forming metal sheets. However, since lightweight and thin-profile electronic products have become a popular trend, the inner space of these electronic products, such as mobile phones, notebook computers and PDAs, will be reduced greatly, thus emphasizing the need for miniature antenna assemblies. For this reason, a new film antenna is developed for lightweight electronic products.

For a regular film antenna, a thin-profile antenna structure is formed on the preset substrate (such as circuit boards, chassis, etc.) by means of printing, evaporation, sputtering and other means. The feed point and grounding portion of the antenna must be electrically connected with the core wire and conductor of a coaxial cable (feeder), thus enabling the feeding of received and transmitted signals. For a solid antenna made of metal sheets, the antenna is coupled with the coaxial cable by means of welding without any damage. For a film antenna, a thin structure is coated onto the surface of substrate. Unfortunately, high-temperature welding causes excessive melting of the film antenna, or even lead indirectly to the damage of the substrate (often made of plastics).

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Based upon the innovation of the present invention, a feeder is coupled with the conducting medium, and the conducting medium is then positioned onto the antenna body. It is possible to provide the combined feeder structure and fabrication method suitable for the film antenna assembly in the present invention. This invention ensures that the film antenna assembly is protected against damage, and a stable electrical connection resolves the coupling issue of the film antenna and feeder for improved applicability and economic efficiency.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
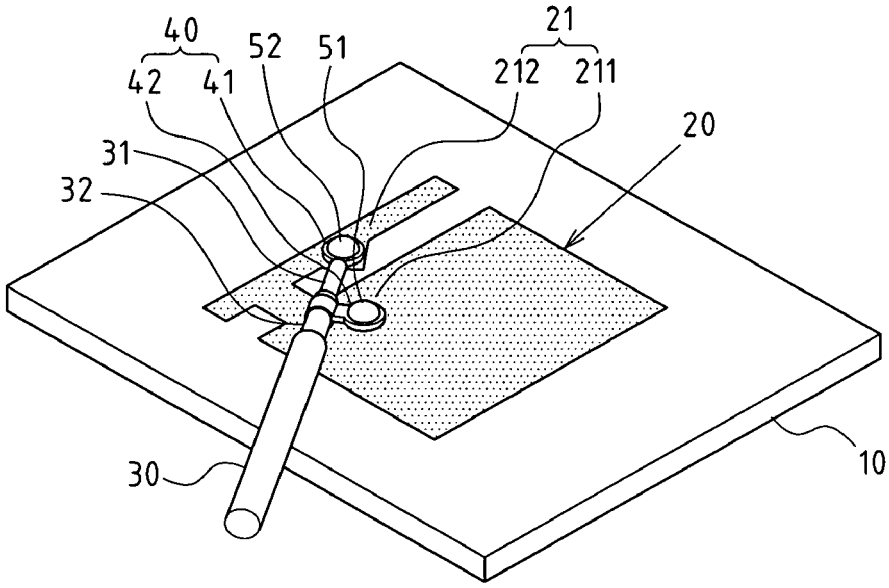
FIG. 1 depicts an assembled perspective view of the first preferred embodiment of the electric field antenna of the present invention.
Figure 2:
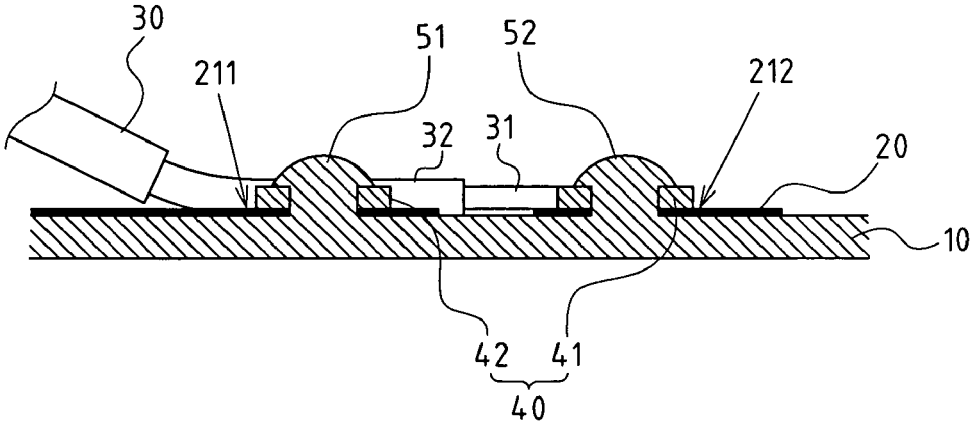
FIG. 2 depicts an assembled sectional view of the first preferred embodiment of the present invention.

FIGS. 1-2 depict preferred embodiments of a film antenna and the fabrication method thereof. The embodiments are provided only for explanatory objectives with respect to the patent claims.

The film antenna assembly comprises a substrate 10, which is assembled onto the circuit board or shell of the electronic product, or other supports and components.

An antenna body 20 is a conducting body placed onto a preset location of the substrate 10. The antenna body 20 is provided with a signal connector 21, which contains a feeding portion 212 and a grounding portion 211.

A feeder 30 is a coaxial cable comprising a core wire 31 and an exterior conductor 32. An intermediate insulating layer is optionally contained in the cable, but is not shown in the present invention.

A conducting medium 40 has one side coupled with the feeder 30 and the other side located on the signal connector 21 of antenna body 20 by several means.

The film antenna of the present invention is fabricated by the following methods. Referring to FIG. 1, the conductive film antenna body 20 has a preset location of the substrate. The signal connector 21 of antenna body 20 is positioned onto and electrically connected with the feeder 30 via a conducting medium 40 by several sequences. For instance, the conducting medium 40 is coupled with the feeder 30, and then with the signal connector 21 of antenna body 20. Alternatively, the conducting medium 40 is coupled with the signal connector 21 of antenna body 20, and then with the feeder 30. Moreover, the antenna body 20 is formed first onto the substrate 10, or the conducting medium 40 is first coupled with the antenna body 20.

The antenna body 20 is formed onto the substrate 10 by either of the following methods or their combinations: printing, evaporation, sputtering, painting or coating.

The conducting medium 40 is made of metal (e.g. metal plate, metal ring and metal sheet), conductive adhesive, or welding material.

The conducting medium 40 is positioned onto the signal connector 21 of antenna body 20 by either of the following components or their combinations: fasteners, elastic components, embedding components, pressing components and adhesives, etc.

The conducting medium 40 could be mated with the feeder 30 through conductive welding, fusion or gluing materials.

The conducting medium 40 and the signal connector 21 of antenna body 20 are coupled as referenced in the accompanying drawings.

Figure 3:
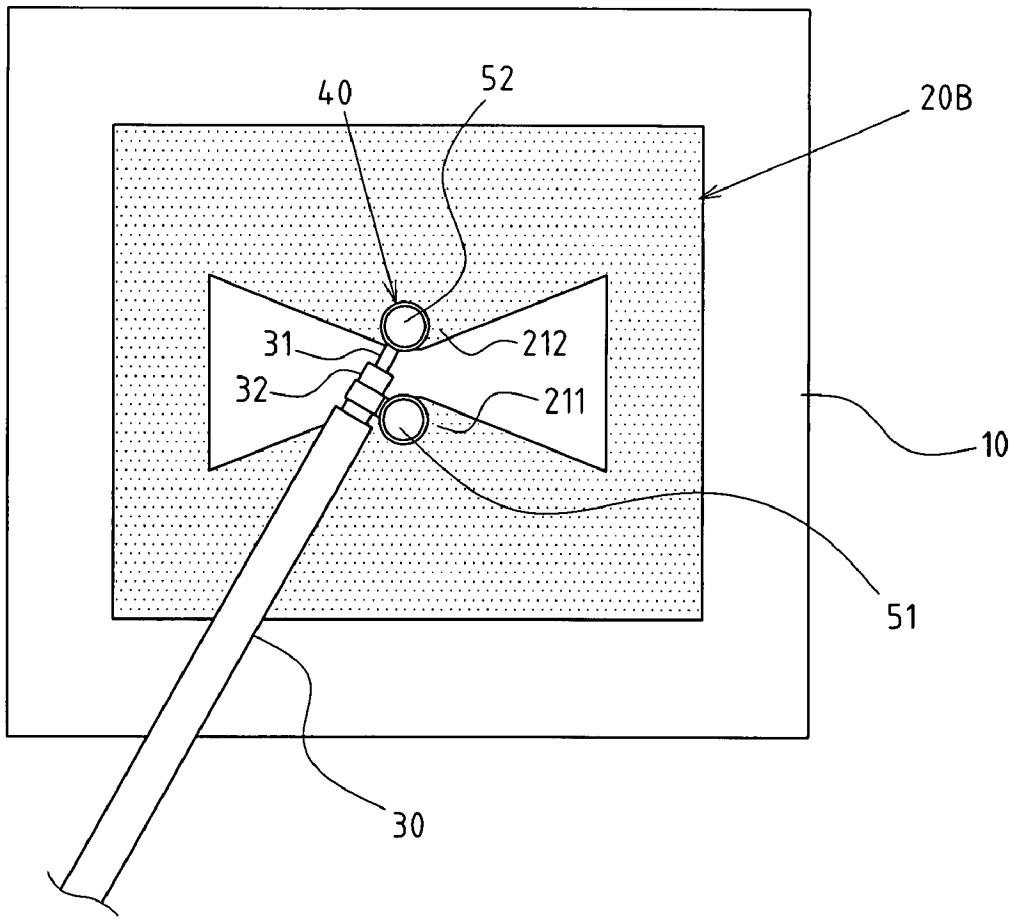
FIG. 3 depicts a top plan view of the application of the present invention when the antenna body is a magnetic field antenna.

Referring to FIGS. 1 and 2, the antenna body 20 of the present invention is configured into a radiative electric field, where the conducting medium 40 is composed of two metal rings 41, 42. One metal ring 41 is mated with the core wire 31 of the feeder 30, and the other metal ring 42 is mated with the exterior conductor 32 of the feeder 30 through two studs 51, 52. The studs 51, 52 are prefabricated by the substrate 10 or fixed by combination. Then, two metal rings 41, 42 are separately positioned via two studs 51, 52 onto the grounding portion 211 and feeding portion 212 of signal connector 21 of the antenna body 20 on the substrate 10 for electric connection. Referring to FIG. 3, the antenna body 20B is configured into a complementary magnetic field, and also positioned similarly by two studs 51, 52.

As illustrated in the following preferred embodiments, the core wire 31 and exterior conductor 32 of feeder 30 must be electrically connected with grounding portion 211 and feeding portion 212 of the signal connector 21 of antenna body 20.

Figure 4:
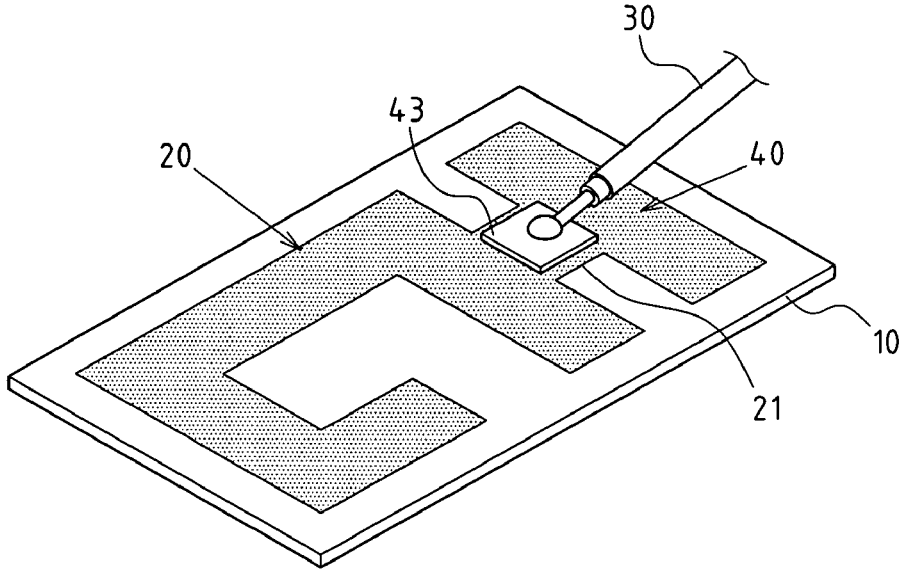
FIG. 4 depicts an assembled perspective view of the second preferred embodiment of the present invention.
Figure 5:
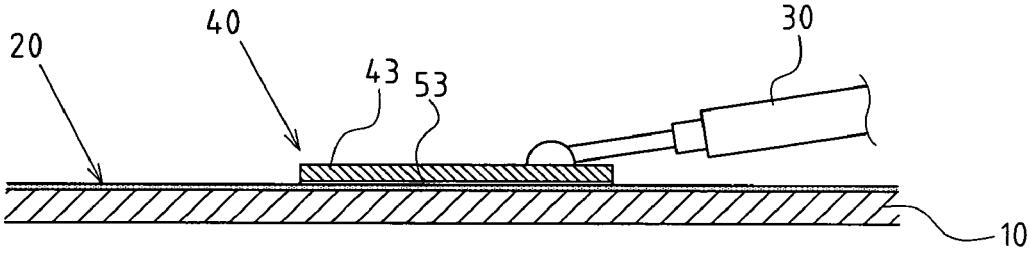
FIG. 5 depicts an assembled sectional view of the structure disclosed in FIG. 4.

Referring to FIGS. 4 and 5, the conducting medium 40 of the preferred embodiment is a metal plate 43. The feeder 30 is welded onto the top of the metal plate 43 with the help of adhesive 53. Referring to FIG. 4, if the adhesive 53 is a conductive adhesive, it can be applied onto entire surface or local surface of the metal plate 43, so that the metal plate 43 is electrically connected with the antenna body 20. If the adhesive 53 is a non-conductive adhesive, it is applied onto local surface of the bottom of the metal plate 43, so that the bottom of metal plate 43 is partially contacted with the antenna body 20 for electrical connection.

Figure 6:
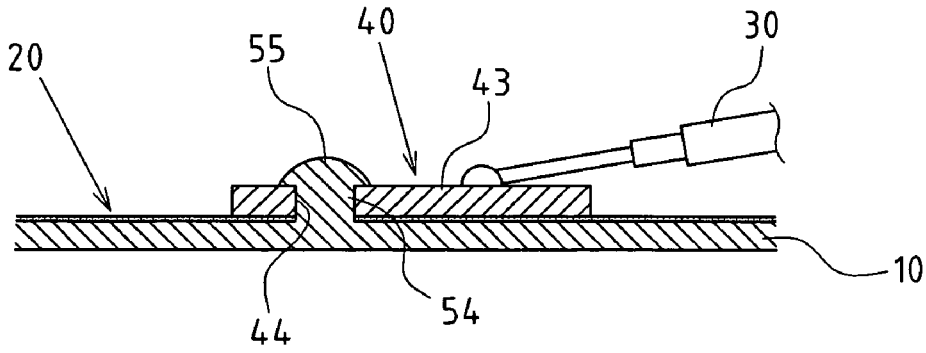
FIG. 6 depicts an assembled sectional view of the third preferred embodiment of the present invention.
Figure 7:
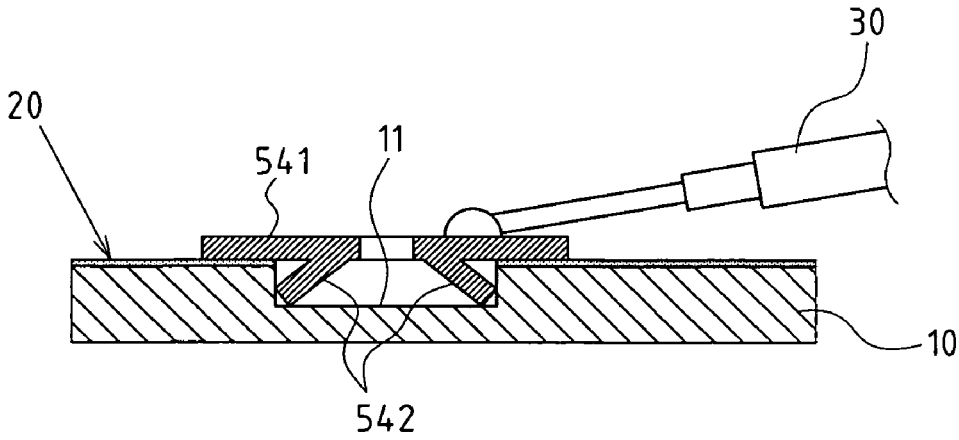
FIG. 7 depicts an assembled sectional view of the fourth preferred embodiment of the present invention.

Referring to FIG. 6, the conducting medium 40 of the preferred embodiment is also a metal plate 43 that is positioned by a stud 54. The stud 54 is prefabricated by the substrate 10. The metal plate 43 is provided with a through hole 44, which could be sleeved onto the stud 54. Then, the protruding top of the stud 54 is formed into an expanded end 55 by heat pressing, so the metal plate 43 and antenna body 20 could be assembled securely. The stud 54 can also be fabricated separately and then assembled into a hole of the substrate. Referring to FIG. 7, the conducting medium 40 could be positioned by an embedding component, which has a contact surface 541 for connecting the antenna body 20. An embedding leg 542 is arranged at the bottom of the contact surface 541, allowing insertion into a preset slot 11 of the substrate 10.

Figure 8:
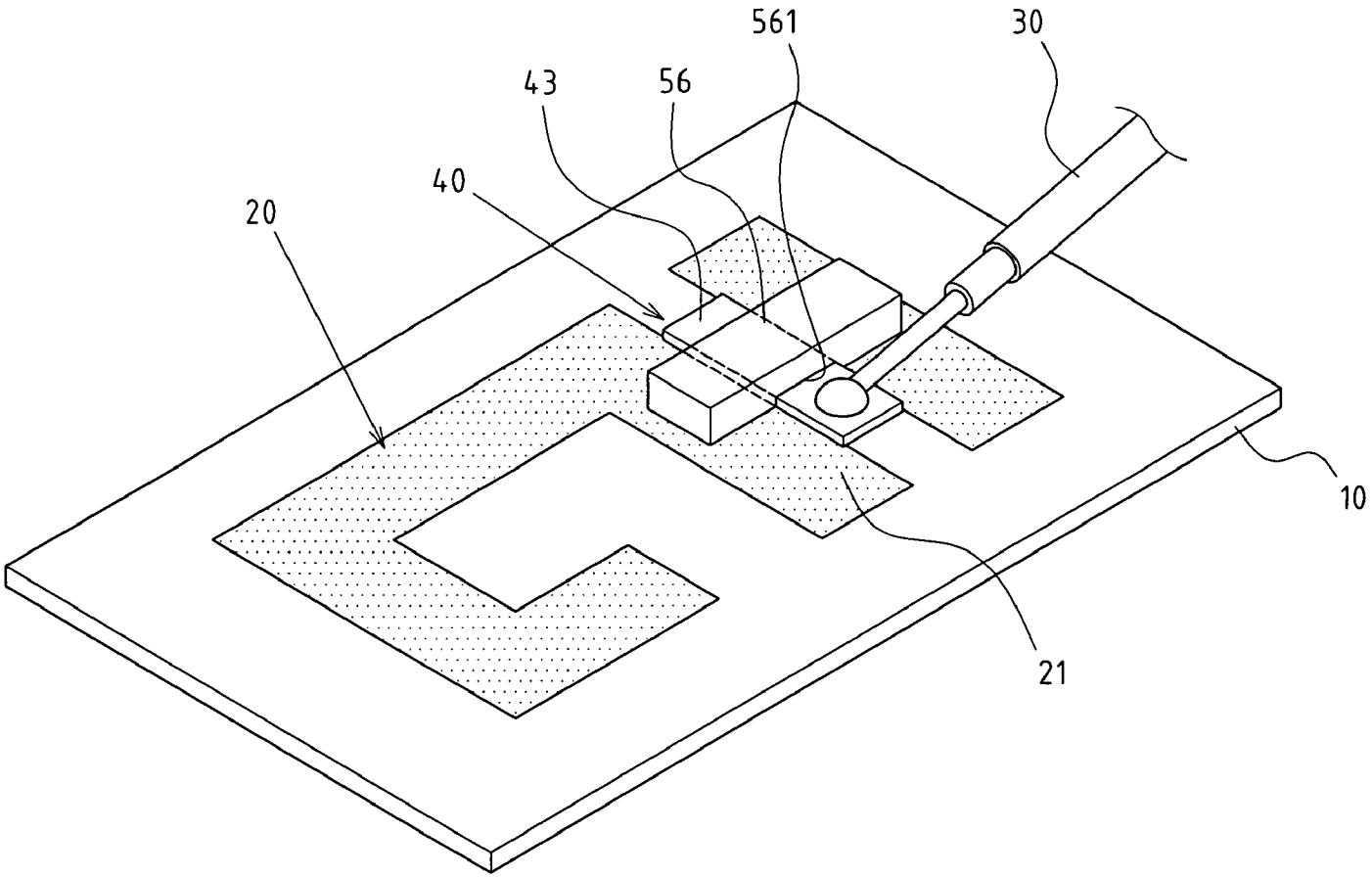
FIG. 8 depicts an assembled perspective view of the fifth preferred embodiment of the present invention.

Referring to FIG. 8, the conducting medium 40 of the preferred embodiment is also a metal plate 43 that is positioned by a pressing component 56. The pressing component 56 is a blocky body and a bottom with a snapping slot 561, enabling the pressing component 56 to be snapped onto the metal plate 43. The bottom of the pressing component 56 is positioned on the signal connector 21 of the antenna body 20 by means of snapping or gluing.

Figure 9:
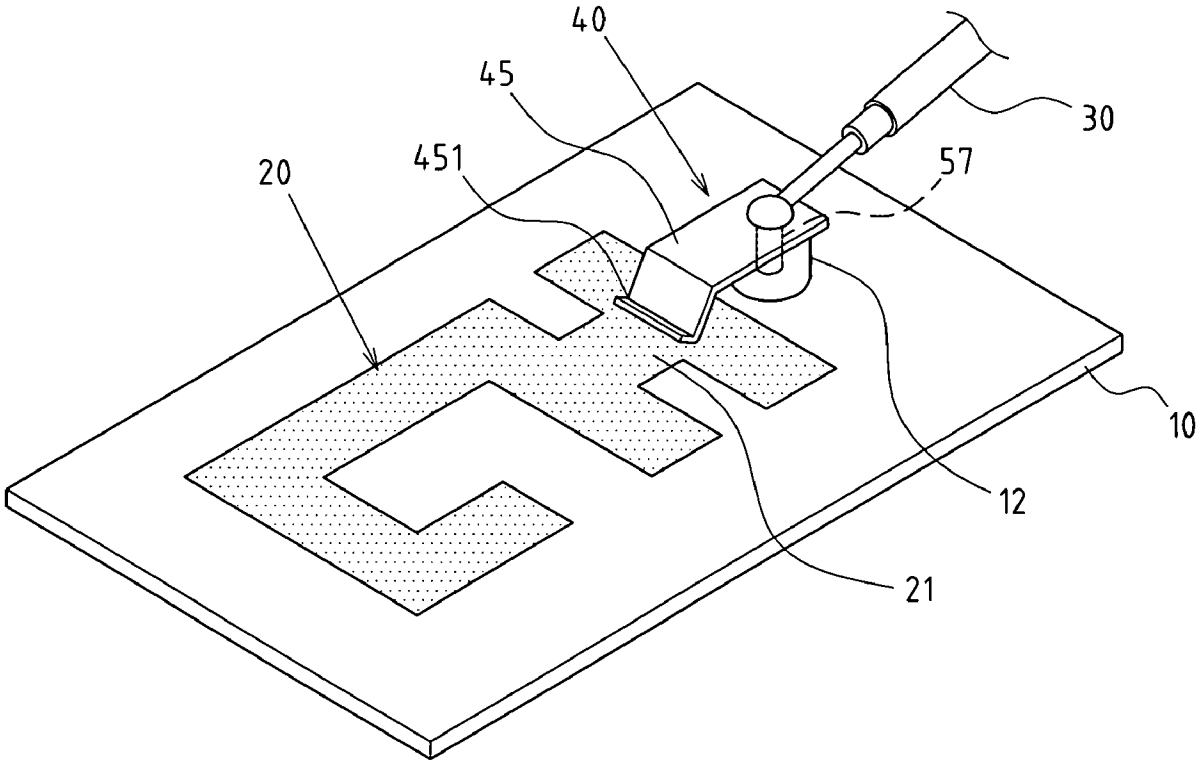
FIG. 9 depicts an assembled perspective view of the sixth preferred embodiment of the present invention.

Referring to FIG. 9, the conducting medium 40 of the preferred embodiment is a metal sheet 45. A downwardly twisting flexible pressing end 451 is laterally arranged onto the metal sheet 45. A protruding tube 11 is formed on the substrate 10 for inserting the plug-in stud 57 so as to position the conducting medium 40.

Figure 10:
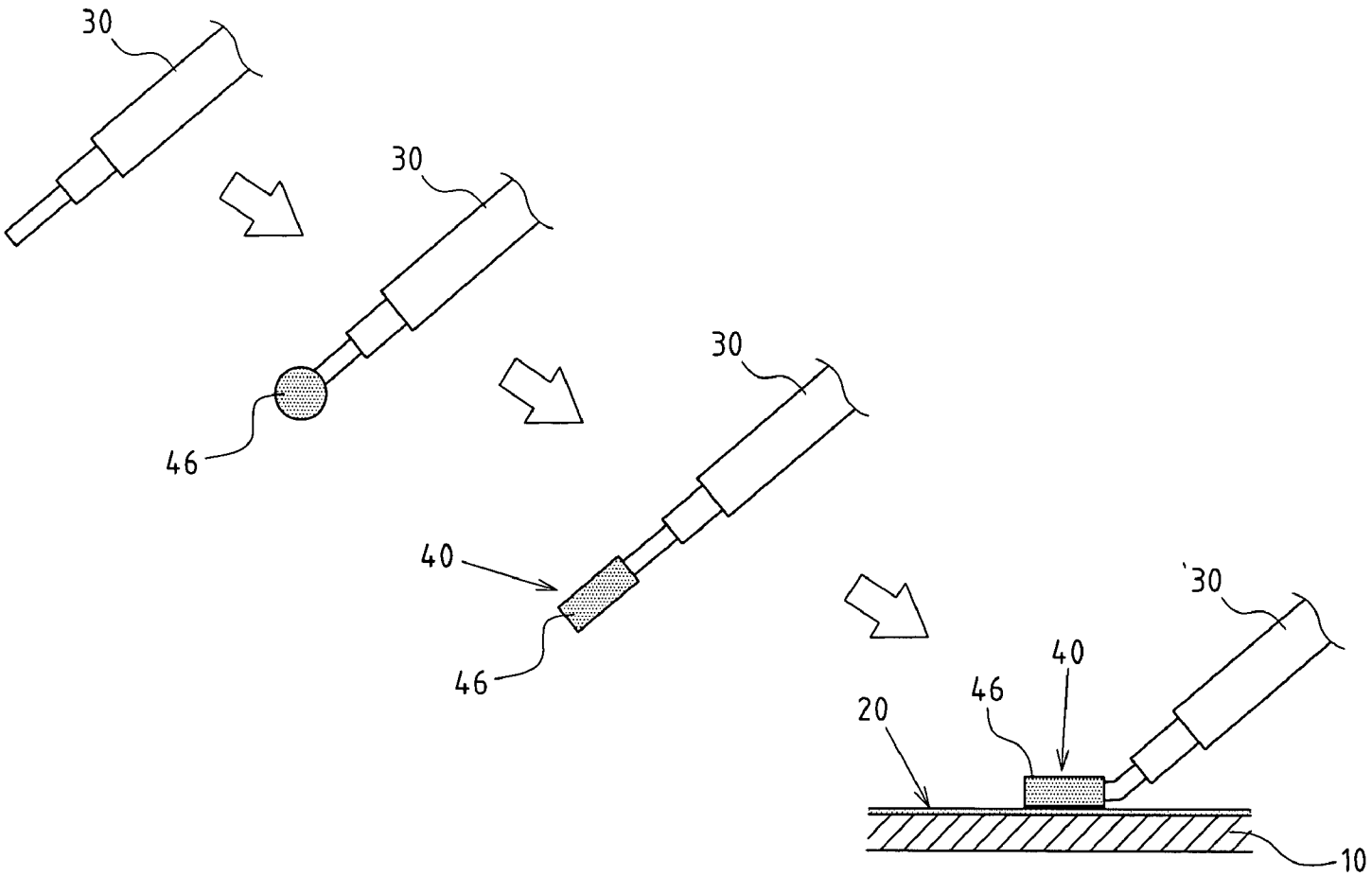
FIG. 10 depicts a partial sectional and side elevational view of the application of the present invention when the conducting medium is fabricated directly by solder.

Referring to FIG. 10, the conducting medium 40 is also fabricated directly by solder 46. As shown by the arrow in the figure, the solder 46 is firstly placed at the core wire 31 of the feeder 30. The solder 46 is firstly processed into a spherical shape, and then pressed into a flat shape, and next the punched solder 46 is fastened onto the antenna body 20 by an ultrasonic way.

Referring also to FIG. 10, the conducting medium 40 of the present invention can also be prefabricated, e.g. the conductive adhesive of conductivity and adhesiveness could help realize the coupling of the conducting medium 40 and feeder 30, or the conducting medium 40 and antenna body 10.

Figure 11:
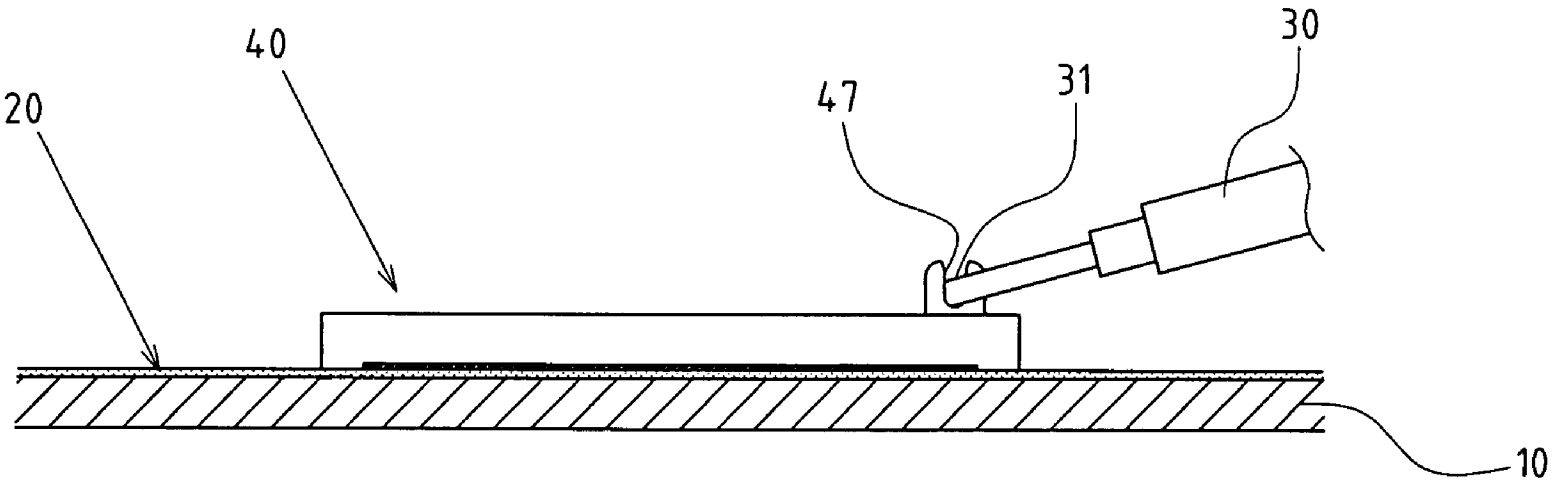
FIG. 11 depicts a sectional view of the application of the present invention when the conducting medium is mated with the feeder via a gripper.

Referring also to FIG. 11, a gripper 47 is placed at top of the conducting medium 40, thereby gripping securely the core wire 31 of the feeder 30 for connection purpose.

We claim:

1. A film antenna assembly comprising:

a substrate;

an antenna body having a conducting body placed on said substrate and a signal connector;

a conducting medium having a first side located on said signal connector of said antenna body and a second side, said conducting medium being positioned onto said signal connector by an embedding component, said embedding component being either prefabricated by said substrate or assembled onto said substrate; and a feeder coupled to said second side of said conducting medium.

2. The film antenna assembly of Claim 1, wherein said conducting medium is comprised of a material selected from the group consisting of a metal, a welding material, a conductive adhesive and a fusion material.

3. The film antenna assembly of Claim 1, wherein said conducting medium is coupled with said feeder by a material, said material being selected from a group consisting of a conductive welding, a fusion material and an adhesive.

4. The film antenna assembly of Claim 1, further comprising:

a gripper positioned on said conducting medium and connected in a secure gripping relationship to said feeder.

5. The film antenna assembly of Claim 1, wherein said signal connector comprises a feeding portion and a grounding portion.

* * * * *